United States Patent [19]

Morton

[11] 4,285,188

[45] Aug. 25, 1981

[54] METHOD OF FILLING AND SEALING CONTAINERS

[76] Inventor: Clifton G. Morton, 4 Stella St., Holland, Queensland, Australia, 4121

[21] Appl. No.: 98,872

[22] Filed: Nov. 30, 1979

Related U.S. Application Data

[62] Division of Ser. No. 963,610, Nov. 24, 1978, Pat. No. 4,220,254.

[30] Foreign Application Priority Data

Nov. 25, 1977 [AU] Australia ..... PD2561

[51] Int. Cl.[3] ..... B67B 1/04; B65B 7/28

[52] U.S. Cl. ..... 53/420; 53/471; 53/489

[58] Field of Search ..... 53/420, 421, 471, 485, 53/489, 412; 220/73, 90, 355

[56] References Cited

U.S. PATENT DOCUMENTS

| | | | |
|---|---|---|---|
| 2,046,609 | 7/1936 | Clark | 53/489 X |
| 2,551,615 | 5/1951 | Maher | 220/355 X |
| 2,960,257 | 11/1960 | Sasse | 220/90 |
| 3,353,706 | 11/1967 | Godshalk | 220/73 |
| 3,469,735 | 9/1969 | Burt | 220/90 |
| 3,604,178 | 9/1971 | Bluhm | 53/412 X |
| 3,748,816 | 7/1973 | Asmus | 53/420 |
| 3,875,651 | 4/1975 | La Croce | 53/485 X |

*Primary Examiner*—Horace M. Culver

*Attorney, Agent, or Firm*—Schwartz, Jeffery, Schwaab, Mack, Blumenthal & Koch

[57] ABSTRACT

A container, of which the body is downwardly tapered to interfit with others for storage or transport, has an outwardly extending circumferential top bead. A separate top ring is formed with an outer inverted annular channel for engagement on the top part and bead of the body, and is also formed with an inner annular channel to receive the downturned peripheral part of a conventional friction-fit lid.

8 Claims, 6 Drawing Figures

METHOD OF FILLING AND SEALING CONTAINERS

This is a division of application Ser. No. 963,610, filed Nov. 24, 1978 and now U.S. Pat. No. 4,220,254.

BACKGROUND OF THE INVENTION

This invention relates to an improved container, and more particularly to a container of the type having a generally cylindrical body closed at the bottom, and with an inwardly extending peripheral ring at the top, made to receive a friction-fit closure or lid. Such containers are commonly used for paint.

Since containers of this type cannot be nested or interfitted one within another, their transport, from a manufacturer to the plant where they are filled and have their closured fitted, is costly, as also is the storage of the containers before they are filled and closed.

The present invention has been devised with the general object of providing containers of the general type described which can be nested or fitted one within another so that a large number of the containers, before being filled and closed, may be stored or transported easily and conveniently.

SUMMARY OF THE INVENTION

With the foregoing and other objects in view, the invention resides broadly in a container of the type having a substantially frusto-conical body with a closed bottom and a bead about its open top, capable of being interfitted with other similar container bodies, wherein a separate top ring is applied to the top of the container said top ring being formed with an outer inverted annular channel closely engaged on the upper part of the container body and its bead, and with an inner annular channel adapted to engage the downturned peripheral part of a friction-fit lid. Preferably the outer inverted annular channel is formed with an upwardly extending shoulder to serve as a fulcrum for a tool used to lever the lid from the container. Other features of the invention will become apparent from the following description.

BRIEF DESCRIPTION OF THE DRAWINGS

In order that preferred embodiments of the invention may be readily understood and carried into practical effect, reference is now made to the accompanying drawings, wherein.

DESCRIPTION OF THE PREFERRED EMBODIMENTS

Figure 1:
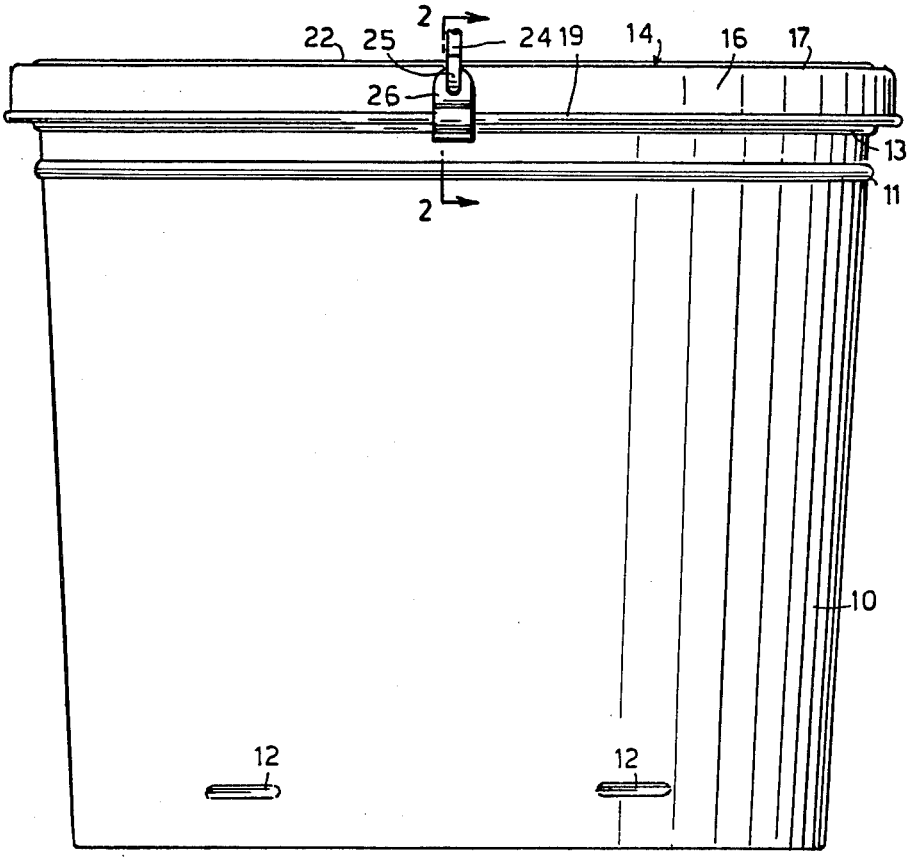
FIG. 1 is a side elevational view of a container according to the invention, part of its carrying handle being omitted.

Each of the containers shown in the drawings includes a body 10 of generally frusto-conical or downwardly tapering form, circular in cross-section, and with a closed bottom. The container bodies are capable of being nested or fitted one within another, and to prevent them from being interfitted too closely and difficult to separate, each of the bodies has a peripheral swedge 11 near to its top, and projections pressed into the interior of the body, near to its bottom, at 12.

Figure 2:
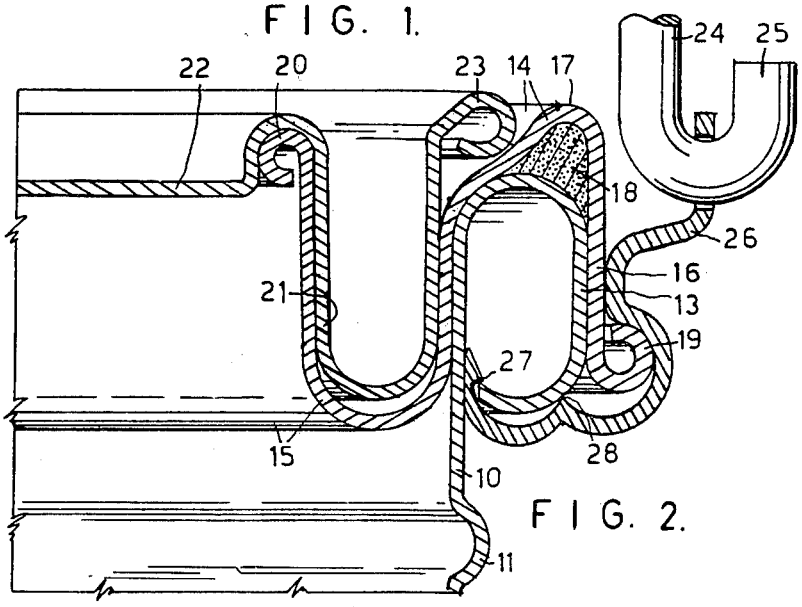
FIG. 2 is a sectional view to larger scale along line 2—2 in FIG. 1.
Figure 4:
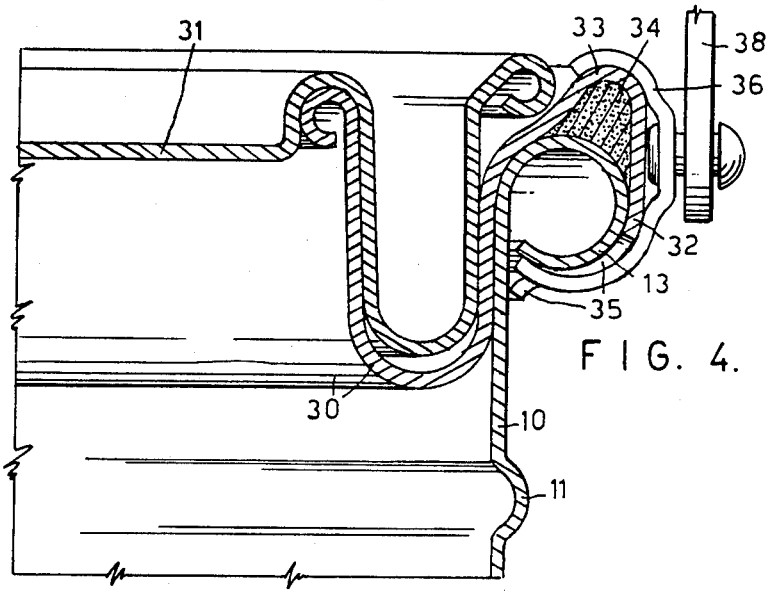
FIG. 4 is a sectional view to larger scale along line 4—4 in FIG. 3.
Figure 6:
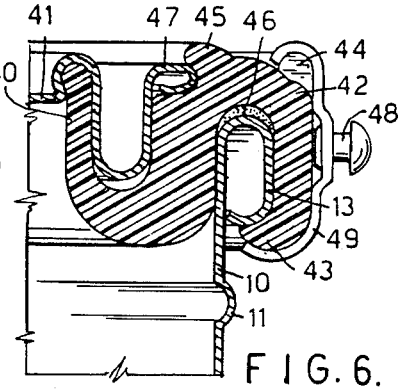
FIG. 6 is a sectional view showing the application of the top ring illustrated in FIG. 5 to a container.

Each container body has its upper edge portion curved outwardly, downwardly and inwardly shaped to form an annular attachment bead 13, the bead shown in FIG. 4 being substantially of circular cross-section, those of FIGS. 2 and 6 being of greater height than width.

Referring now to FIGS. 1 and 2 of the drawings, a top ring 14 is provided for quick and easy application to the container body 10. The top ring is of sheet metal shaped to form an annular inner channel 15 and an annular inverted outer channel 16. The outer channel 16 is made to fit tightly over the top part of the container body 10 and its attachment bead 13, and it is also formed with an annular upwardly extending shoulder 17 so that there is a space between this shoulder and the top of the attachment bead. To assist in securing the top ring in air-tight manner to the container body a gasket compound or other adhesive and/or sealing substance, indicated at 18, is introduced to the shoulder 17 before the top ring is fitted to the container body.

The bottom of the outside flange of the outer channel 16 is shaped to form a finishing bead 19, and the top of the inside flange of the inner channel 15 is likewise shaped to form a bead at 20.

The inner channel 15 is shaped to receive closely the downwardly extending peripheral channel 21 of a generally conventional friction-fit closure or lid 22, the outer edge of this channel 21 being shaped to form an edging bead 23 in usual manner. When the lid is fully engaged as shown in the drawings, its edging bead 23 seats on the top of the outer channel 16 of the top ring, a short distance inwardly of the annular shoulder 17.

A wire carrying handle, of which part is indicated at 24, is shaped at its ends to form hooks 25 each of which is engaged in a hole in one end of a handle attachment bracket 26. At its other end, the bracket is sharpened and formed with a tooth 27, so it can be inserted between, but not easily withdrawn from, a narrow gap between the wall of the container body 10 and the extremity of the attachment bead 13. The bracket is also shaped to bear, at 28, under the attachment bead 13, and to fit closely over the finishing bead 19 and adjacent to the top ring above this finishing bead. The two diametrically opposed handle attachment brackets 26 therefore assist in securing the top ring 14 to the container body 10 as well as providing firm attachment points for the hooked ends of the handle 24.

Any desired number of the container bodies 10 may be nested or fitted closely one within another for convenience in transport or storage. The top rings 14 may be supplied by a manufacturer with the lids 22 already fitted so that, when a container body is filled with paint, for example, the top ring, with lid, is fitted to the body of inserting gasket compound or the like in the shoulder 17 and pressing the outer channel 16 down on the upper part of the container body, and then installing the handle attachment brackets 26 with which the ends of the handle 24 are first engaged. The lid can be opened by inserting a suitable tool between its finishing bead 23 and the annular shoulder 17 of the top ring, and levering the lid up from the top ring.

Figure 3:
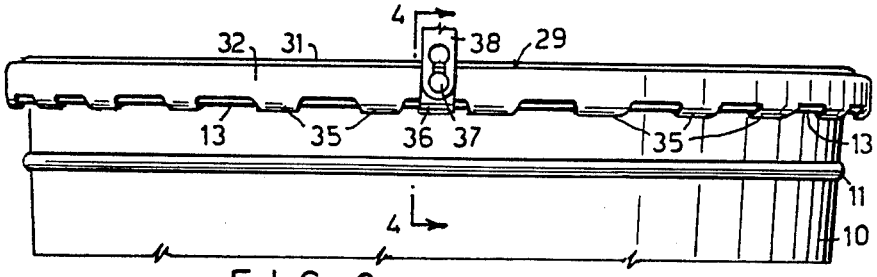
FIG. 3 is a partly broken-away side elevational view of a container according to an alternative embodiment of the invention.

Referring now to the embodiment shown in FIGS. 3 and 4, the container has a top ring 29 generally as before described with an inner channel 30 for engagement with a lid 31 and an outer inverted channel 32 with a shoulder 33 containing gasket compound or the like at 34, the outer channel being shaped for engagement with the top of the container body 10 and the attachment bead 13. In this form of the invention, however, the outer flange of the outer channel 32 is formed with a series of equally spaced holding lugs 35 which are shaped, by any suitable device, to engage closely under the attachment bead 13 to hold the top ring firmly on the container body. Each of a pair of similar handle attachment brackets 36 engages over the top of the shoulder 33 and, passing between two of the lugs 35, under the attachment bead 13. A stud 37 extending from the bracket 36 is engaged with an end of a carrying handle part of which is shown at 38.

Figure 5:
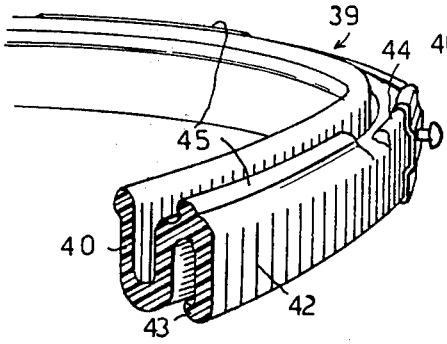
FIG. 5 is a perspective view of part of a top ring of a container according to another embodiment of the invention.

In FIGS. 5 and 6, the top ring 39 is made of a moulded plastics material which is resiliently deformable. The inner channel 40 is shaped to accept the down-turned channelled rim of the lid 41. The inverted outer channel 42 is shaped to fit closely over the top of the container body 10 and its attachment bead 13, and it is also shaped, at the bottom of its outer flange, to form an inturned lip 43 which engages closely under the bead 13. The outer channel 42 is formed at the top with a series of spaced arcuate shoulders 44 alternating with a series of arcuate lid retaining projections 45.

The outer channel 42 is so dimensioned that it will contain a quantity of gasket compound or the like at 46 when engaged on the top part and attachment bead 13 of the container body 10.

When the lid is fully engaged with the top ring 39, the finishing bead 47 of the lid is engaged by the resiliently deformable lid retaining projections 45. The lid may be levered from the container by the use of a suitable tool fulcrumed on a shoulder 44 and engaged under the finishing bead 47 of the lid.

The carrying handle (not shown) of this container has its ends engaged with studs 48 projecting from a pair of brackets 49, each having its top curved to fit over a shoulder 44 and its bottom curved to fit under the bottom lip 43 of the outer channel 42.

It will be apparent that a large number of the containers, nested together, and their separate top rings, may be packaged for storage or transport in a very considerably less space than would be required for a like number of conventional containers. The top rings may be supplied with the closures already fitted, if desired, so that after the open-topped containers have been filled, the top rings with closures may be applied.

Alternatively, the closures may be supplied separately from the top rings, the top rings being applied to the containers before filling of the paint or other material into the containers, the closures then being fitted in usual manner. In either case, the top rings may be fitted to the containers easily and quickly by pressure applied to the top rings by simple and economical means and techniques.

Containers made according to the invention will be found to be very effective in achieving the objects for which they have been devised. It will, of course, be understood that the particular embodiments of the invention herein described and illustrated, may be subject to many modifications of constructional detail and design, which will be readily apparent to skilled persons, without departing from the scope of the invention hereinafter claimed.

I claim:

1. A method of handling, filling and sealing container assemblies for paint and other material, comprising the steps of:

(a) providing a container of substantially frusto-conical shape having a continuous side wall, a closed bottom and an outer annular bead formed at the top of said side wall, the outer face of said bead being spaced substantially from the plane of said side wall, the frusto-conical shape of said container permitting interfitting of a plurality of containers;

(b) providing a top ring which can be shipped separately from said container and applied thereto after the container is filled, said top ring having an outer inverted channel adapted to extend around the bead of the container but spaced from the top thereof to form a space into which sealing compound can be placed before the top ring is secured to the container, and an inner annular channel open at its top, the respective side walls of said inner channel being substantially spaced from one another;

(c) providing a friction-fit lid having an annular downwardly turned peripheral channel adapted to extend into and be frictionally retained by said inner channel of the top ring;

(d) separately stacking a plurality of containers provided by step (a) for storage and transportation purposes wherein each respective frusto-conical container is interfitted one with another;

(e) transporting the stacked containers to a material filling station;

(f) transporting said top rings and lids to said filling station;

(g) unstacking the containers and filling each container with paint or other material and, (h) applying said top ring and lid to each filled container whereby the top ring is secured and sealed to the bead of said container.

2. The method of claim 1 wherein said top rings and said lids are shipped separately to the filling station and are applied in sequence to the container after it is filled, whereby the top ring is secured by sealing compound to said container bead and the downturned peripheral channel of said lid is thereafter extended into and retained by the inner channel of the top ring.

3. The method of claim 1 further including the step of combining, prior to transporting, the top ring with the lid by extending the downwardly turned peripheral channel of the lid into the inner channel of the top ring for frictional retention thereby, and thereafter shipping the lid-top ring assemblies separately from the stacked containers.

4. A method of handling, filling and sealing metal container assemblies for paint and other material, comprising the steps of:

(a) providing a container of substantially frusto-conical shape having a continuous side wall, a closed bottom and an outer annular bead formed at the top of said side wall, the outer face of said bead being spaced substantially from the plane of said side wall, the frusto-conical shape of said container permitting interfitting of a plurality of containers;

(b) providing a top ring which can be shipped separately from said container and applied thereto after the container is filled, said top ring having an outer inverted channel adapted to extend around the bead of the container and an inner annular channel open at its top, the respective side walls of said inner channel being substantially spaced from one another;

(c) providing a friction-fit lid having an annular downwardly turned peripheral channel adapted to extend into and be frictionally retained by said inner channel of the top ring;

(d) separately stacking a plurality of containers provided by step (a) for storage and transportation purposes wherein each respective frusto-conical container is interfitted one with another;

(e) transporting the stacked containers to a filling station;

(f) transporting said top rings and said lids to the filling station;

(g) unstacking the containers and filling each container with paint or other material; and (h) applying said top ring and lid to each filled container, the top ring being secured to the bead of each container for securing the ring and lid in a closed position.

5. The method of claim 4 wherein said top rings and said lids are shipped separately to the filling station and are applied in sequence to the container after it is filled, whereby the top ring is secured to said container bead and the downturned peripheral channel of said lid is thereafter extended into and retained by the inner channel of the top ring.

6. The method of claim 4 further including the step of combining, prior to transporting, the top ring with the lid by extending the downwardly turned peripheral channel of the lid into the inner channel of the top ring for frictional retention thereby, and thereafter shipping the lid-top ring assemblies separately from the stacked containers.

7. The method of claims 1 or 4 wherein said top ring is formed of a resilient plastic material, with the outer inverted channel being formed at the top thereof with a plurality of arcuately spaced lid-retaining projections, and further including the step of resiliently distorting said projections by an exterior finishing bead formed on said lid during assembly of said lid to said top ring, said projections supplementing the frictional retention of said lid on said top ring.

8. The method of claim 7 wherein said outer inverted channel is further formed with spaced arcuate shoulders radially outward of said projections, and further including the step of applying brackets to said top ring, with the upper portions of said brackets extending over said shoulders.

* * * * *